US008128784B2

(12) United States Patent
Vilpponen et al.

(10) Patent No.: US 8,128,784 B2
(45) **Date of Patent: *Mar. 6, 2012**

(54) BLEACHING PROCESS OF CHEMICAL PULP

(75) Inventors: Aki Vilpponen, Varkaus (FI); Panu Tikka, Espoo (FI)

(73) Assignee: Oy Lannen Tutkimus—Western Research Inc., Espoo (FI)

( * ) Notice: Subject to any disclaimer, the term of this patent is extended or adjusted under 35 U.S.C. 154(b) by 397 days.

This patent is subject to a terminal disclaimer.

(21) Appl. No.: 12/295,357

(22) PCT Filed: Mar. 27, 2007

(86) PCT No.: PCT/FI2007/050167

§ 371 (c)(1),
(2), (4) Date: Nov. 10, 2008

(87) PCT Pub. No.: WO2007/113380

PCT Pub. Date: Oct. 11, 2007

(65) Prior Publication Data

US 2009/0277596 A1 Nov. 12, 2009

(30) Foreign Application Priority Data

Mar. 31, 2006 (FI) ..... 20060313

(51) Int. Cl.
*D21C 9/16* (2006.01)

(52) U.S. Cl. ..... 162/67; 162/60; 162/72

(58) Field of Classification Search ..... 162/60, 162/67, 72

See application file for complete search history.

(56) References Cited

U.S. PATENT DOCUMENTS 5,352,332 A 10/1994 Maples et al.
5,509,999 A * 4/1996 Lindberg ..... 162/29
6,258,208 B1 7/2001 Lindeberg
6,306,253 B2 10/2001 Henricson
6,432,266 B1 * 8/2002 Fukushima et al. ..... 162/65
6,540,872 B1 4/2003 Dahl
6,736,934 B1 * 5/2004 Henricson et al. ..... 162/19

FOREIGN PATENT DOCUMENTS

WO WO 9527100 10/1995
WO WO 9606976 3/1996
WO WO 9715713 5/1997
WO WO 9821400 5/1998

OTHER PUBLICATIONS

Bucher et al., A Survey of Mills Using Caustic Extraction Stage Chemistry, Aug. 2005, 2005 Engineering, Pulping & Environmental Conference, whole document.*

Gullichsen et al., Chemical Pulping 6A, 1999, Fapet Oy, p. A635-A665.*

International Search Report dated Jun. 28, 2007, in PCT application.

Ljungren, S. et al., "Chlorine Dioxide Bleaching with Two-Step Low-to-High pH Profile", Tappi J. vol. 79 (1996), No. 12, pp. 152-160.

* cited by examiner

*Primary Examiner* — Matthew Daniels
*Assistant Examiner* — Anthony Calandra
(74) *Attorney, Agent, or Firm* — Young & Thompson

(57) ABSTRACT

A process for the bleaching of chemical pulp, comprising a first chlorine dioxide treatment (D) of the initial bleaching and chelation (Q) to be carried out in connection therewith, forming together a DQ treatment. The process is characterized in that the chelation is carried out at the pH of from 2 to 7, and it is followed by an alkalizing stage (N) of the pulp, without intermediate washing for raising the pH of the pulp to above 7 and at most to 12 prior to a following stage which is a washing step.

16 Claims, 7 Drawing Sheets

BLEACHING PROCESS OF CHEMICAL PULP

FIELD OF THE INVENTION

This invention relates to the bleaching of chemical pulp. More particularly, the invention relates to initial bleaching of sulphate pulp, bleaching sequences and filtrate cycles related thereto. Said initial bleaching comprises chelation of the pulp in a chlorine dioxide stage of the initial bleaching and a subsequent addition of alkali prior to a washing step following said stage.

BACKGROUND OF THE INVENTION

The bleaching of sulphate pulp is divided into initial and final bleaching. During the initial bleaching, most of the lignin present in the pulp is removed. In the final bleaching, the residual lignin still present in the pulp is removed, and pulp darkening coloured groups, chromophores, are converted into the non-light-absorbing form.

Conventionally the initial bleaching consists of two stages: an acid delignification stage such as a chlorine dioxide stage D0 followed by a washing step, and an alkaline extraction stage E, which is often reinforced with oxygen and peroxide (EOP) or one of these (EO or EP). Between the D0 and E stages the pulp is washed. Said first acid delignification stage removes a main part of metals present in the pulp as well as hexenuronic acids consuming bleaching chemicals. The reactions of chlorine dioxide in the D0 stage are rapid. Although the dosage of an active agent in the D0 stage is often relatively high, a main part of the charged chemicals is consumed in a few seconds. However, the retention time in the D0 stage is usually about 30 minutes to ensure the reaction of all chemicals and to achieve a kappa number after the D0 EOP stages being as low as possible.

The reactions of chlorine dioxide degrade the lignin structures. A part of lignin is removed in the washing step of the D0 stage, but a substantial part of the reacted lignin will be converted into a dissolving form only in a following alkaline stage. Therefore, the filtrate resulting from the E stage contains a remarkable amount of dissolved organic matter as well as chlorine bound to the lignin during the D0 stage.

When an effluent cycle of a bleaching process is closed, the amount of effluents to be discharged has been tried to reduce by using filtrates in other processes of the mill, i.a. for washing of brown stock. Thereby the filtrates and the dissolved wood material and chemicals present in the filtrate are led to a recovery process of chemicals. The filtrates resulting from the D0 stage contain a main part of chlorides which are detrimental to a recovery process. Therefore, there has been efforts primarily to recover and circulate in the process filtrates resulting from the alkaline stage of bleaching. However, also the filtrates resulting from the alkaline stage subsequent to the D0 stage contain chlorine compounds.

When using peroxide, the transition metals, such as Mn, Fe and Cu, are removed or their content is reduced prior to a peroxide stage. An advantageous metal profile in the peroxide stage decreases the degradation of a bleaching perhydroxide ion —OOH into oxygen radicals. Thereby, in the peroxide stage a greater increase in brightness can be achieved by a smaller peroxide consumption. Also the viscosity of the pulp is better maintained in the treatment.

A sufficiently acid treatment removes metals, but optimally chelation is carried out so that the removal of transition metals is as effective as possible, while alkaline earth metals Mg and Ca protecting the pulp and reducing the degradation of peroxide, will remain in the pulp. An optimal chelating pH is from 4 to 7. At higher pH the removal of all metals will decline, at lower pH also the protecting alkaline earth metals will be removed.

PRIOR ART

Chelation is conventionally carried out in a separate stage, if necessary. In patent applications WO 96/06976, WO 95/27100 and WO 98/21400 chelation is presented to be carried out in connection with a chlorine dioxide stage, without intermediate washing.

WO 96/06976 describes that chelation is carried out either prior to addition of chlorine dioxide or after it. The pH range of the chelation stage is mentioned to be from 1.5 to 8, preferably from 2 to 4. According to the disclosure of WO 95/27100 chelation is carried out prior to, during or after a chlorine dioxide stage. The chelation is strived to be carried out in an optimal pH range from 3 to 7, preferably from 4 to 6.

In WO 98/21400, the pH of pulp is raised to a value >8.5 prior to chelation. By alkaline conditions, residual chlorine dioxide is aimed to be inactivated and calcium to become precipitated onto fibres. However, the use of chlorine dioxide in the D0 stage, to which chelation is combined, is limited to an amount of at most 15 kg as active chlorine per ton of absolutely dry pulp in order to keep the amount of chlorides small and to reduce the drawbacks resulting from the recovery of the filtrates. Absolutely dry means pulp dried at 105° C.

SUMMARY OF THE INVENTION

An object of the invention is an initial bleaching stage of a new kind. According to the invention, chelation (Q) of pulp is carried out in connection with a first chlorine dioxide stage (D) of the initial bleaching, and after a reactive stage, alkali is added to the pulp to neutralize or alkalize the pulp, hereafter expressed as N. The pulp is not washed between the first D stage, to which chelation is combined, and the N stage of the initial bleaching. In this context, the initial bleaching sequence according to the invention is expressed as DQN.

A chelating agent is added prior to or especially subsequent to the chlorine dioxide treatment or between two chlorine dioxide treatments. In this context, an expression DQ is used for the chlorine dioxide stage, in connection with which the chelation is carried out in the above-mentioned manner, irrespective of the addition sequence of the agents. The chelation stage (Q) is not separated from the D0 stage with an intermediate washing step. The chelating pH is from 2 to 7. Alkali is added to the pulp subsequent to the chelation and the chlorine dioxide treatment in the same stage for raising the pH of the pulp to above 7 and at most to 12 prior to a following stage, washing, in order to dissolve organic matter. The treatment according to the invention intensifies the effectiveness of the following bleaching stages, reduces the consumption of bleaching chemicals, especially in the initial bleaching, except for alkali, and improves particularly the utilization of the filtrates resulting from the alkaline stage following the DQN stage in washers.

When chlorine dioxide reacts, components of the pulp binding metals, such as hexenuronic acid groups, are degraded, thus facilitating removal of metals. The rise of the pH after the chelation does not impair the removal of metals in a washing step following said stage, because a resulting chelate-metal-complex is sufficiently stable. The rise of pH to be neutral or alkalic after chelation increases the amount of dissolved organic matter, enabling thus free metal ions to be attached to the dissolved matter and not to the fibres.

The object of the present invention is to improve the removal of reacted organic matter in a first chlorine dioxide stage and to reduce the amount of chlorine compounds being passed to a following bleaching stage. At the same time, reduction of the content of the transition metals contained in the pulp or a substantial removal thereof is ensured by chelating the pulp under optimal conditions, enabling thus a greatest possible amount of the transition metals (Mn, Fe and Cu) to be chelated, while a significant part of alkaline earth metals (Mg, Ca) will remain in the pulp. Thereby the effectiveness of the following bleaching stages will be intensified, and the recovery and usability of the filtrates resulting from them for other pulping processes, such as for washing of brown stock and in different bleaching stages will be improved.

By the process according to the invention a greater amount of dissolved matter and organic chlorine compounds can be removed in the D0 stage of the initial bleaching than in a washing step subsequent to an acid chlorine dioxide stage, simultaneously maintaining an effective removal of the transition metals. The chelation is carried out under more advantageous conditions than in a process described in WO 98/21400, and the upper limit of the amount of chlorine dioxide is not limited.

BRIEF DESCRIPTION OF THE DRAWING FIGURES

Accompanying FIGS. 1 to 10 show a few preferred bleaching sequences or sections thereof, as well as filtrate cycles thereof using the initial bleaching sequence DQN according to the invention.

DETAILED DESCRIPTION OF THE INVENTION

Figure 1A:
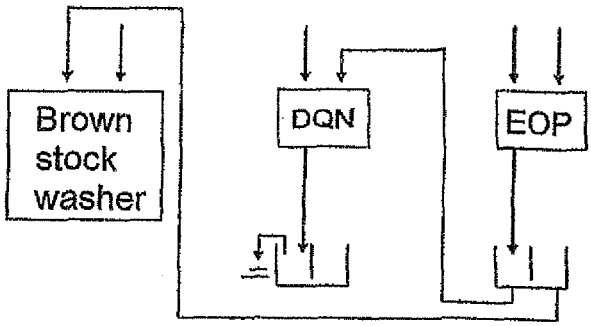
FIGS. 1A to 2B show a few preferred washing water connections of the DQN EOP bleaching.

A DQN treatment, to which the invention relates, is carried out as a first chlorine dioxide treatment of the bleaching. A chelating agent is added prior to or especially after the chlorine dioxide treatment or between two chlorine dioxide stages. The DQN treatment can be carried out in a conventional thickness of the D0 stage, in a thickness of from 1 to 40%. The temperature of the treatment is preferably from 50 to 100° C., more preferably from 60 to 95° C., whereby the treatment becomes more effective when the temperature rises. When the addition is carried out after the chlorine dioxide treatment, the chelation can be accomplished e.g. in a connection pipe to a washer or in a separate reactor. Also the addition of alkali to be carried out at the end of the DQN stage can be realized e.g. in a connection pipe to the washer or in a separate reactor.

In the process according to the invention, the chlorine dioxide treatment of the initial bleaching can be carried out under conditions of a conventional D0 stage. In the process according to the invention, the retention time in the chlorine dioxide stage of the DQN stage is from 10 sec to 120 min, preferably from 1 to 30 min, most preferably from 1 to 15 min, the active chlorine dosage (kg/adtp) is about 2 to 2.5 times the kappa number or from 10 to 60 kg as active chlorine per ton of air dry pulp (hereafter expressed as kg act. Cl/adtp), preferably from 15 to 60 kg act. Cl/adtp, most preferably from 20 to 50 kg act. Cl/adtp, the final pH is from 1 to 5, preferably from 2 to 3.5, and the thickness is from 1 to 40%, preferably from 3 to 12%. Air dry pulp means in this context a pulp, having a dry matter content of 90%. The temperature is preferably from 50 to 100° C., especially from 60 to 95° C. The neutralizing or alkalizing steps carried out after the addition of chlorine dioxide and the chelation lowers the kappa number and improves the effectiveness of the following bleaching stages, reducing thus the consumption of the chemicals in the bleaching. In the first chlorine dioxide stage of the bleaching, the dosage of the chemicals can be reduced, if desired. When the required chemical dosage is smaller, the charged chlorine dioxide is consumed very rapidly and the required retention in the chlorine dioxide treatment is decreased. The decreased need of chlorine dioxide results in a decrease of the need to adjust pH in the Q stage as well as the consumption of alkali in the alkalizing following the DQ treatment. In said D treatment of the DQN stage the pulp may, in addition to chlorine dioxide, be treated also with ozone, peracetic acid or caron acid or a combination of these.

The metals present in the pulp are in a dissolved ionic form in sufficiently acid conditions, but precipitate when pH rises. As a chelating agent, e.g. EDTA (ethylenediaminetetra acetic acid) or its salt or DTPA (diethylenetriaminepenta acetic acid) or its salt are suitable. The suitable dosage is from 0.1 to 3 kg/adtp, particularly from 0.1 to 1 kg/adtp. The chelation is preferably carried out in the pH range of from 2 to 7, particularly from 4 to 7, whereby the transition metals (e.g. Fe, Mn, Cu) are chelatable, but a main part of the alkaline earth metals Mg and Ca will remain in the pulp. The retention time in the chelation treatment is from 10 sec to 60 min, preferably from 1 to 10 min.

The chelating agent may be added prior to the addition of chlorine dioxide, or when chlorine dioxide is added in several stages, also between the additions of $ClO_2$, especially prior to the last addition of chlorine dioxide. In these cases, alkali is added directly after the active stage of chlorine dioxide prior to the washing step.

After the chlorine dioxide and chelation stage, alkali is added to the pulp prior to the washing step in order to neutralize or alkalize the pulp prior to the washing. Differing from a conventional alkali treatment separated with washing or displacement, the alkalization according to the invention carried out prior to washing does not aim at an effective alkali stage, such as a second stage EOP of initial bleaching but also a mild treatment is sufficient. After the addition of alkali (N) in the DQN stage, the pH is above 7. Said pH after the addition of alkali is preferably at most 12, in one embodiment especially at most 10. Generally, good results are obtained by a pH value of from 8 to 11. In one embodiment said pH is above 10, but at most 12. When the pH is above 10, the content of the organic chlorine compounds (AOX) generated in the chlorine dioxide treatment begins to decrease due to their degradation, resulting in a decrease of the toxicity of the effluents resulting from the stage. A suitable alkali dosage is preferably from 1 to 20 kg alkali as NaOH/ton of air dry pulp (kg as NaOH/adtp), preferably from 1 to 15 kg as NaOH/adtp. The effective time is from 5 sec to 60 min, preferably from 40 sec to 15 min, the temperature is from 50° C. to 100° C., preferably from 60 to 95° C. and the thickness is in conformity to the preceeding treatment. A rise of the pH and the temperature or an increase of the retention time will result in an increase of the lowering of the kappa number, but the consumption of alkali increases correspondingly. By the alkali treatment, the organic material reacted during the chlorine dioxide treatment and the chloride bound thereto are dissolved from the pulp, and are removed in the washing step following the DQN stage. Thereby the content of dissolved matter of a following bleaching stage, preferably the EOP stage, will decrease and its effectiveness will be improved. The removal of metals from the pulp will not be impaired, although the pH of the pulp is raised higher than an optimal chelating pH after the addition of a chelating agent prior to washing.

As alkaline in the DQN stage, especially sodium hydroxide or oxidized or unoxidized white liquor or any combination of these can be used. Particularly, the use of white liquor is possible, because no oxidizing chemicals are used in the alkali treatment of the DQN stage.

From the DQN stage of the process according to the invention, a filtrate is obtained containing a greater part of the chlorides and the dissolved organic matter than earlier as well as a main part of the transition metals. The pH of the filtrate is preferably above 7 and at most 12, more preferably from 8 to 11. In one embodiment, said pH is above 7, but below 10. In another embodiment, the pH of the filtrate is above 10, but at most 12. Thereby the alkalic washing water filtrates resulting from the DQN stage can also be passed to a separate container for degrading the organic chlorine compounds prior to conducting them to an effluent recovery. A filtrate to be removed from next washer, preferable the EOP stage washer, contains a smaller amount of chlorides and dissolved organic matter than a filtrate resulting from a EOP stage subsequent to a conventional D0 stage. A purer filtrate containing a smaller amount of chlorides is more suitable for washing or dilution of brown stock or different stages of the bleaching.

A washer arranged after a first D stage (D0) of the initial bleaching according to prior art operates under acid conditions. A filtrate resulting from the DQN stage is neutral or alkalic, allowing thus the filtrate cycles in the bleaching to be arranged in a new way.

When using white liquor or oxidized white liquor for alkalizing the pulp in the DQN stage, the Na/S balance of the chemical cycle can be adjusted in a new way, and foreign matters present in the white liquor, such as Al, Cl, K and Si can be removed. A decrease in the consumption of sodium hydroxide in the EOP stage reduces the influence on the Na-balance of a mill, if the filtrates are conducted to the recovery via brown stock washing.

Compounds causing precipitation, such as $CaC_2O_4$, $CaCO_3$, $BaSO_4$ as well as magnesium compounds will precipitate onto the fibres when the pH rises. Therefore, the demand for magnesium addition in the EOP stage decreases. The precipitation of calcium carbonate may be controlled by limiting the pH of the alkali treatment following the chelation to a value of below 10.

When using the initial bleaching according to the invention, the fiber pulp entering the initial bleaching is chemically produced, especially by a sulphate cook. The pulp enters the initial bleaching from a brown stock washer arranged after the cook or an oxygen stage.

After the DQN stage and the subsequent washing of the pulp, any suitable bleaching sequence may be used in order to obtain a target value of the final brightness for the pulp.

The DQN stage can also be adapted in connection with a hot treatment for removing hexenuronic acids. A preferred bleaching sequence is one having as first three stages A DQN EOP. The invention enables also full bleaching with a small chemical consumption using a short bleaching sequence, e.g. DQN PO. In using the DQN stage according to the invention, other preferred bleaching sequences are e.g. DQN EOP D1, DQN EOP D1 D2, DQN EOP D1 P, A DQN D1 P, DQN DP, DQN EOP P, DQN EOP Z P or DQN EOP Px, wherein Px is an acid peroxide stage. Spacings between the stages refer to a washing step between the stages.

An unpressurized EOP stage can also be carried out without oxygen, so that in the present application the expression EOP refers also to an unpressurized EP stage.

In the figures each box provided with a symbol representing the respective bleaching stage refers to a washer arranged after said stage. The arrows directed towards each of the washers refers to washing liquids entering the washer, whereby the left arrow indicates a first washing liquid and the right arrow indicates a following washing liquid. An arrow leaving a washer indicates a washing filtrate being discharged from the washer, whereby the filtrate may be as a single fraction or is divided into different fractions, e.g. in these examples into two fractions. A first washing liquid of the washing liquids used in the washers displaces the liquid present in the pulp at its entry into the washer, which liquid is passed into a filtrate container, whereby the first washing liquid will remain in the pulp. This first washing liquid is displaced by a second washing liquid, whereby also a greater part of the first washing liquid will enter the filtrate container of said washer. All or part of the second washing liquid will remain in the pulp leaving the washer. When the washer is a press, the term first washing liquid refers to an actual washing liquid, whereby the term second washing liquid refers to a dilution after the washer. Also, when washers of another type, e.g. a filter or a DD washer, are used, a part of the second washing liquid may be used for the dilution after the washer.

In all shown figures, the filtrate leaving a washer may be divided into different fractions with respect to their properties (e.g. with respect to the amount of dissolved matter), which fraction are led to a filtrate container, in which filtrate container they can be stored separately and be used separately. In this case, the concentration of the filtrate (e.g. the amount of dissolved matter) discharged from the left side of a filtrate container, shown in the figures below a washer, is higher than that of the filtrate to be withdrawn from the right side of the filtrate container, or the arrow coming out from the left side indicates the liquid displaced from the pulp by the first washing liquid, and the arrow coming out from the right side indicates the liquid displaced by the second washing liquid. The washing filtrates may also be stored in the filtrate container mixed with each other, in which case the filtrate outflows have similar properties. In the shown preferred embodiments, the pulp is washed using two washing liquids. In the shown preferred embodiments, the filtrate discharged from the filtrate container is used as a washing liquid in one or two washers or it is removed from the process. It is also possible to divide the amount of the washing waters and the use of the filtrate waters in any other manner, suitable for the purpose.

Figure 2A:
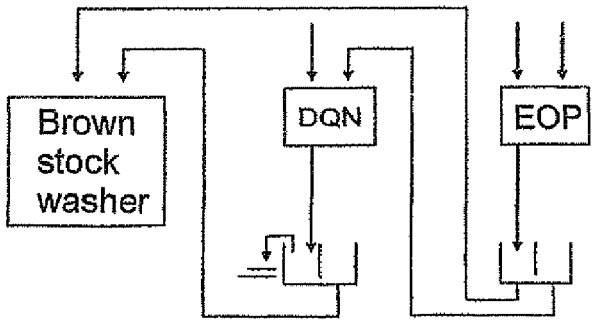
Figure 2B:
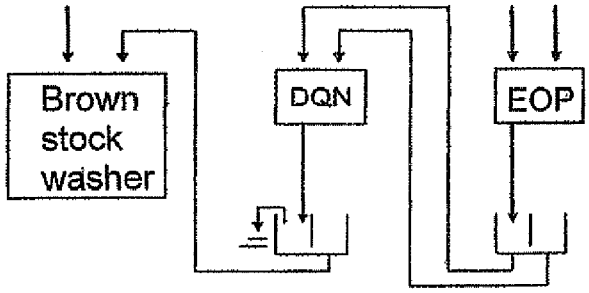
Figure 3:
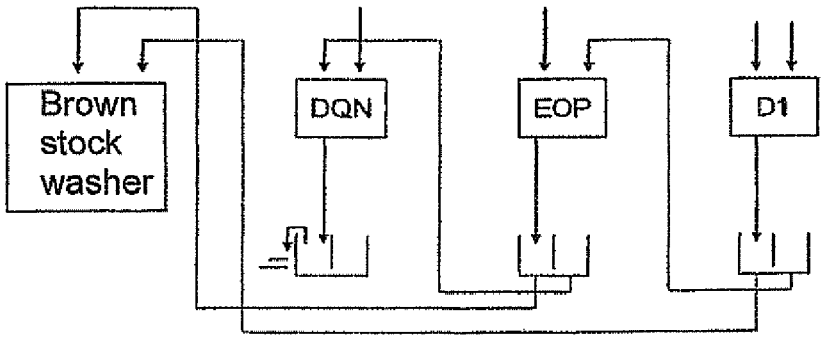
FIG. 3 shows a preferred washing water connection of the bleaching beginning with the DQN EOP D1 sequence.

Except for FIGS. 1 to 3, each of the figures shows the whole bleaching sequence used. In the shown figures, the arrows showing a washing liquid entering a washer, but not coming out of a filtrate container, indicate a liquid outside the bleaching. This may be e.g. a condensate, 0 water or raw water of a dryer. The embodiments shown in FIGS. 1 to 3 may disclose a whole bleaching sequence, or the washing liquid entering the washer of the last stage may also be a filtrate from a washer of later bleaching stages, if one or more bleaching stage or stages were additionally added to the end of the presented bleaching sequence.

Figure 1B:
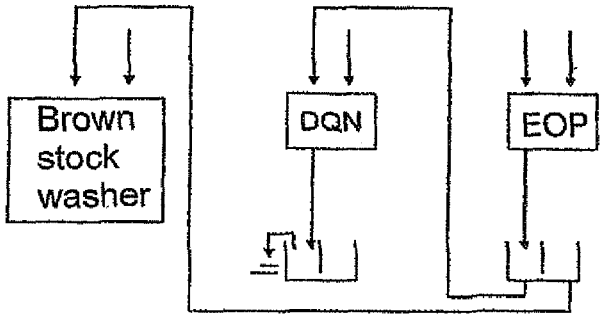
Figure 1C:
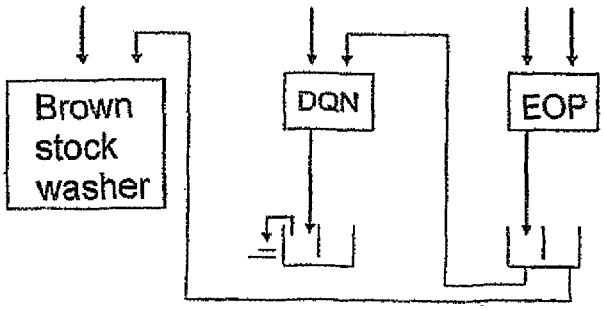

FIGS. 1A, 1B and 1C show a few preferred ways of arranging the washing water connection of the DQN EOP bleaching. In FIG. 1A, as both washing liquids in the EOP washer, a liquid coming outside the bleaching is used. The first filtrate fraction displaced from the pulp by a first washing liquid in the EOP washer is used as second washing water of the DQN washer. The fraction displaced by the second washing liquid of the EOP washer is used as first washing water of the brown stock washer. The second washing water of the brown stock washer and the first washing water of the DQN washer are a liquid outside the bleaching. All washing filtrates from the DQN washer are passed to effluent treatment. The first and second washing water entering the DQN washer may also be arranged inversely (FIG. 1B). In the cycle of FIG. 1C, the filtrate resulting from the bleaching is used as the last washing liquid in a washer (a brown stock washer) preceding the bleaching or for dilution, but the bleaching filtrates are not passed to a recovery process.

FIGS. 2A and 2B show a preferred way of arranging the washing water connection of the DQN EOP bleaching wherein the amount of effluent has further been reduced. The first washing filtrate fraction from the EOP stage is led to brown stock washing, and the second washing filtrate fraction is used as the second washing liquid of the DQN washer. The second washing filtrate fraction from the DQN stage is used as the last washing filtrate in a washer preceding the bleaching or for dilution, and it will remain in the pulp. The first washing liquid of the DQN washer is a liquid outside the bleaching, and the first washing filtrate displaced by it is passed to the effluent treatment. The second washing filtrate from the EOP stage could also be used as first washing water for the DQN washer, whereby the second washing water of the DQN washer would be a liquid outside the bleaching. In the embodiment of FIG. 2B, all washing waters of the DQN stage are washing filtrates resulting from the EOP stage, and the first washing water of the brown stock washer is a liquid outside the bleaching.

FIG. 3 shows a preferred way of arranging the washing water connection of the DQN EOP D1 bleaching. The D1 stage may further be followed by a bleaching stage, whereby the washing waters of a D1 washer, or one of them, may result from any of the following bleaching stages. A part of the filtrate (the first fraction) from the EOP stage is used as first washing water of brown stock. A part of the filtrate (the first fraction) resulting from the D1 stage is used as the last washing water in a washer preceding the bleaching or for dilution, and it will remain in the pulp and reduces the need of acidification in the DQN stage, enabling thus the utilization of the residual chlorine dioxide of the D1 stage. The washing filtrates removed from the pulp in the DQN washer are passed to the effluent treatment. Here a first washing liquid of the DQN washer is the second washing filtrate fraction from the EOP washer, and a second washing liquid is a liquid outside the bleaching. In another embodiment the filtrate water cycles are as shown in FIG. 3, but the washing waters entering the DQN washer are arranged inversely, i.e. as first washing water of the DQN washer, a liquid outside the bleaching is used, and as second washing water, the second washing filtrate from the EOP washer is used.

Figure 4:
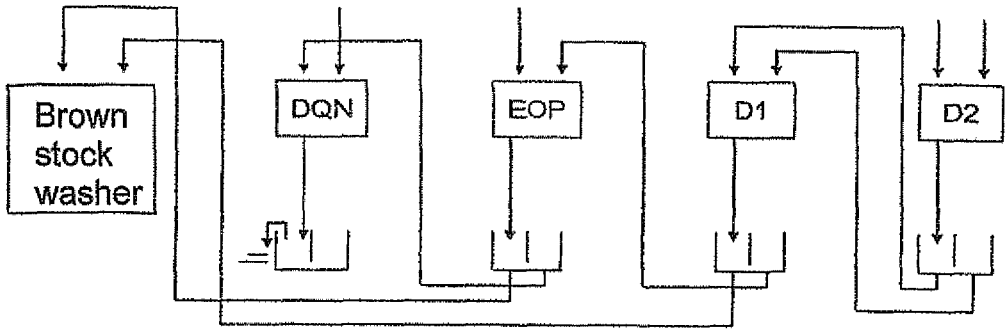
FIG. 4 shows a preferred washing water connection of the DQN EOP D1 D2 bleaching.

FIG. 4 shows a preferred way of arranging the filtrate cycle of the DQN EOP D1 D2 bleaching. Washing and filtrate waters are arranged as in the embodiment of FIG. 3, but first and second washing water of the D1 washer are the first and a second washing filtrate from the D2 washer. The first and second washing water of the DQN washer may also be arranged inversely, as is described in connection with FIG. 3.

Figure 5:
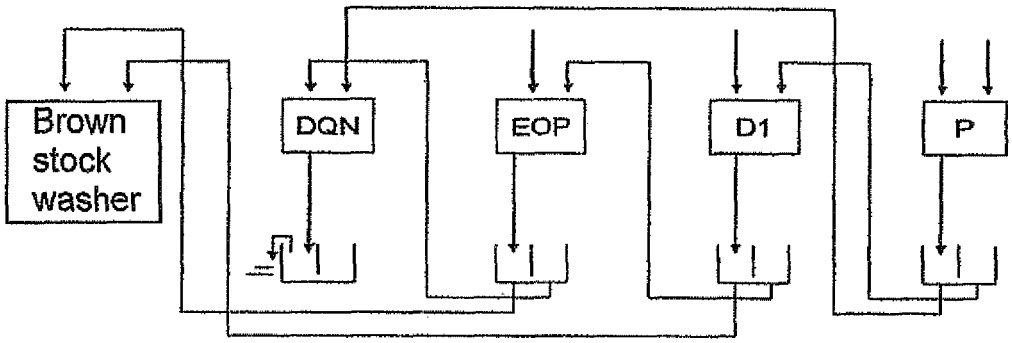
FIGS. 5 and 6 show a few preferred washing water connections of the DQN EOP D1 P bleaching.

FIG. 5 shows a preferred way of arranging the filtrate cycle of the DQN EOP D1 P bleaching. The filtrate waters of a brown stock washer as well as the washers of the DQN, EOP and D1 stages are arranged as in the embodiment of FIG. 3, as also the washing waters of the EOP washer and the brown stock washer. The first washing water of the D1 washer is a liquid outside the bleaching, but its second washing water is the second washing filtrate fraction from a P washer. The first washing filtrate fraction resulting from the P washer is used as second washing water for the DQN washer. In another embodiment, the washing waters of the DQN washer are arranged inversely, i.e. its first washing water results from the P washer (the first washing filtrate fraction) and its second washing water results from the EOP washer (the second washing filtrate fraction).

Figure 6:
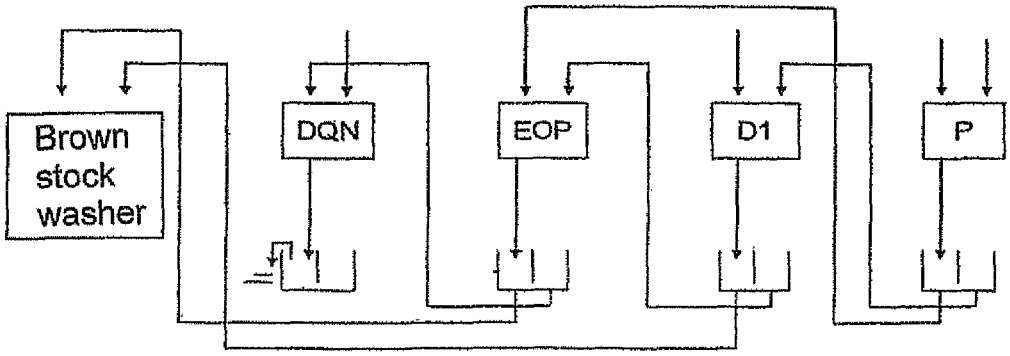

FIG. 6 shows another preferred way of arranging the filtrate and washing water connection of the DQN EOP D1 P bleaching. The washing water and filtrate flows are arranged as shown in FIG. 3, but as first washing water of the EOP washer, the first washing filtrate fraction from the P washer is used, and as second washing water of the D1 washer, the second washing filtrate fraction from the P washer is used. In another preferred embodiment, the washing waters of the DQN washer are arranged inversely to that of FIG. 6, i.e. its first washing water results from the EOP washer (the second washing filtrate fraction) and its second washing water results from the P washer (the first washing filtrate fraction).

Figure 7A:
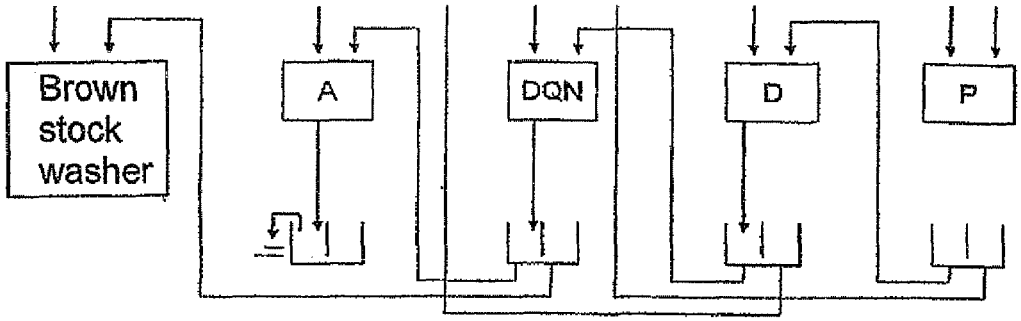
FIGS. 7A and 7B show a few preferred washing water connections of the A DQN D1 P bleaching.
Figure 7B:
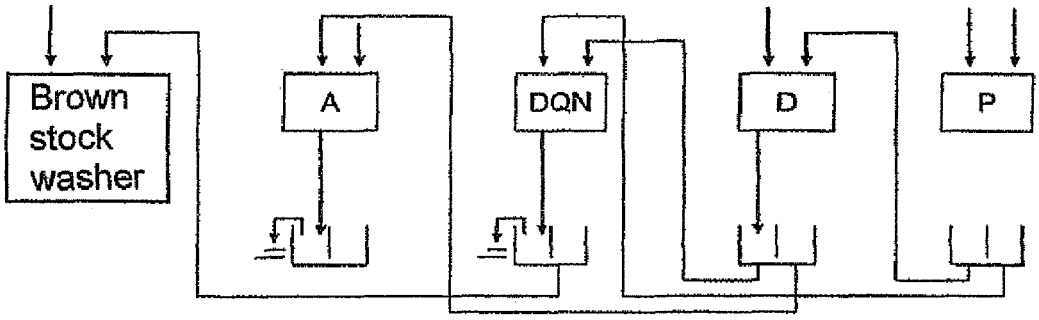

FIGS. 7A and 7B show some preferred ways of arranging the filtrate cycle of the A DQN D1 P bleaching comprising a separate A stage. In the embodiment of FIG. 7A, all filtrate water resulting from the washer of the A stage is passed to effluent treatment, and as second washing water of the A stage, the first washing filtrate fraction from the DQN washer is used. In the embodiment of FIG. 7B, the second washing water of the A stage washer is replaced by a liquid outside of the bleaching compared to the embodiment of FIG. 7A, and the first filtrate fraction resulting from the DQN washer is passed to the effluent treatment. The embodiment of FIG. 7B could also be changed so that the sequence of the first and second washing waters of the A stage is reversed, i.e. the first washing water of the A stage would be a liquid outside the bleaching. The embodiment of FIG. 7B may also be modified so that, instead of a liquid outside the bleaching, the second washing filtrate fraction from the DQN washer is used as second washing water of the A stage washer, whereby the second filtrate water fraction from the A stage washer is used as second washing water in the brown stock washer. Still another modification of the embodiment of FIG. 7B is to conduct all washing filtrates resulting from the DQN washer to the effluent treatment. Thereby the second washing filtrate fraction from the D1 washer is used as second washing water of the A stage washer, and as first washing water of the A washer, a liquid outside the bleaching is used.

Figure 8A:
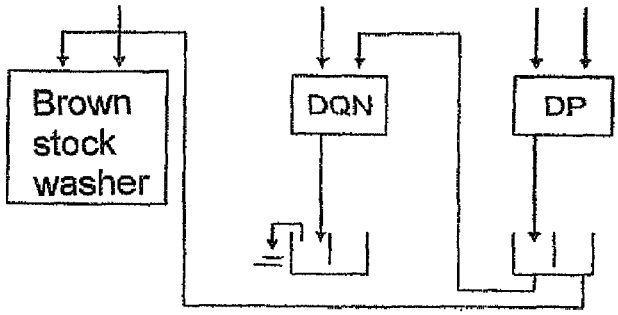
FIGS. 8A and 8B show a few preferred washing water connections of the DQN DP bleaching.
Figure 8B:
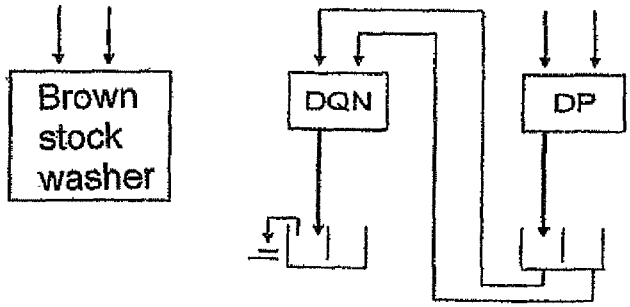

FIGS. 8A and 8B show a few preferred ways of arranging the filtrate and washing water connection of the DQN DP bleaching. When using the DQN DP sequence, the amount of resulting effluent is especially small compared to bleaching according to the prior art. The first washing filtrate fraction from the DP stage washer is used as first (not shown in the figure) or as second washing water for the DQN washer, and the second washing filtrate fraction resulting from the DP washer is used as first washing water for brown stock. As other washing waters, a liquid outside the bleaching is used. The washing filtrate from the DQN washer is passed to the effluent treatment. The embodiment of FIG. 8A may also be modified so that the second washing filtrate fraction from the DQN washer is used in the brown stock washer as second washing water, instead of a liquid outside the bleaching. By this kind of embodiment, a smaller effluent amount can be achieved. In the arrangement of FIG. 8B, the filtrates resulting from the bleaching are not used for washing of brown stock.

Figure 9A:
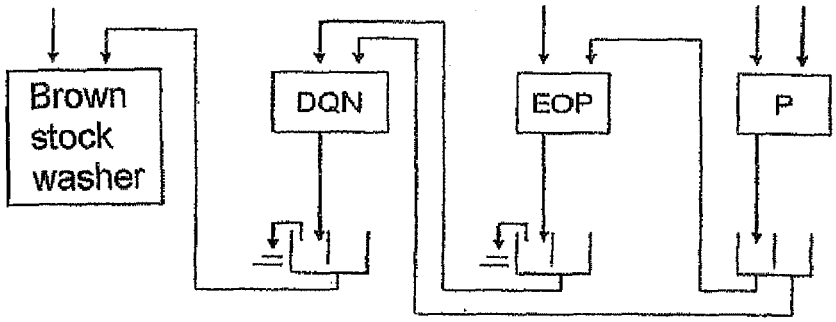
FIGS. 9A to 9C show a few preferred washing water connections of the DQN EOP P bleaching.
Figure 9B:
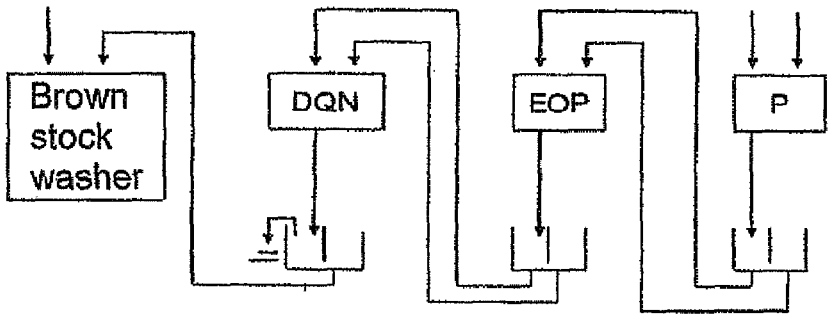
Figure 9C:
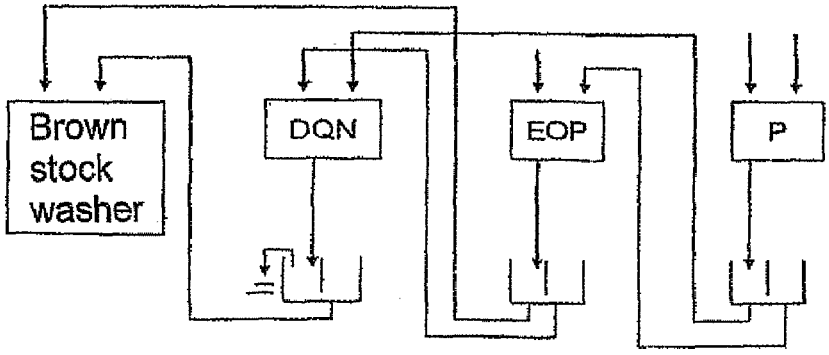

FIGS. 9A to 9C show a few preferred ways of arranging the washing water connection of the DQN EOP P bleaching wherein the amount of resulting effluent is small. The embodiment of FIG. 9A may be modified so that the first and second washing water of the DQN washer are reversed. In the embodiment of FIG. 9B, both washing filtrates from the washers of the P and EOP stages are used as washing waters in a washer preceding each stage. The first washing filtrate fraction from the DQN washer is passed to the effluent treatment, and the second washing filtrate is used as second washing water in the washer of brown stock. In the arrangement of FIG. 9C, both washing waters of the brown stock washer result from washers of the bleaching stages, and first washing water of the EOP washer is a liquid outside the bleaching. In the washing and filtrate water cycle of FIGS. 9B and 9C, the amount of resulting effluent of bleaching is still reduced. The filtrate resulting from the DQN stage could, in its whole, also be passed to the effluent treatment, and instead of said filtrate, a liquid outside the bleaching could be used in the brown stock washer.

Example 1

In laboratory experiments softwood sulphate pulp, having a kappa number of 25.0, a brightness of 30% ISO and a viscosity of 1280 ml/g (SCAN) was subjected to a DQN initial bleaching according to the invention, followed by an EOP stage (DQN EOP), and as a comparison sample (ref) a D0 EOP initial bleaching. Both sequences were carried out using two different $ClO_2$ dosages (kappa factor 1 and 2), at a temperature of 65° C. The temperature of the EOP stage was 85° C., and the retention time in all treatments was 60 min. $ClO_2$ was allowed to react for 30 min. The final pH of the D stage was from 2 to 3. In the DQN treatment subsequent to this, the pH of the pulp was adjusted to 5 by adding alkali, and a chelating agent was added to the pulp (reaction time 5 min), whereafter addition of alkali was carried out (N), whereby the pH of the mixture was raised to 8 and 11. Alkali was allowed to act for 5 min. In the chelation and during the addition of alkali, the temperature was about 50° C. Table 1 shows the chemicals dosages used, the consumption of alkali in the DQN stage, and the properties measured from the pulp after the D0 or DQN treatments as well as after the whole initial bleaching.

The DQN treatment lowered the kappa number after the EOP stage by about one unit, and enhanced pulp brightness (ISO) after the EOP stage by 4.5 to 93 units compared to the reference D0 EOP sequence at kappa factor 2. The influence of the DQN treatment on the viscosity of the pulp was insignificant compared to the drop in kappa number.

The consumption of alkali in the N stage was about 30% of the dosage of active chlorine of the chlorine dioxide treatment, when the pH was raised to 8 in the N treatment, and about 40% of the dosage of active chlorine when the pH was raised to 11. The final pH of the chlorine dioxide treatment was from 2 to 2.5. The DQN treatment reduces the consumption of alkali in the EOP stage compared to the EOP stage subsequent to the D0 treatment. The total consumption of alkali in the DQN EOP sequence was from 1 to 10 kg/odt higher than in the reference sequence D0 EOP.

Residual peroxide (not indicated in the table) in the EOP stage (DQN kappa factor 2, pH after addition of alkali 10.7) was 4 kg $H_2O_2$/odt when the dosage of peroxide was 6 kg $H_2O_2$/adtp, i.e. the chelation was effective although the pH was raised to be alkalic after the addition of DTPA. The treatment according to the invention enables to achieve enhanced pulp brightness and kappa reduction in the EOP stage.

TABLE 1

| | | Kappa factor 1 | | | Kappa factor 2 | | |
|---|---|---|---|---|---|---|---|
| | | kf1 ref | kf1 DQN 8 | kf1 DQN11 | kf2 ref | kf2 DQN8 | kf2 DQN11 |
| $ClO_2$ | kg act. Cl/adtp | 25 | 25 | 25 | 50 | 50 | 50 |
| DTPA | kg/adtp | — | 1 | 1 | — | 1 | 1 |
| addition of alkali | pH at the end of the addition | — | 7.9 | 10.8 | — | 7.8 | 10.7 |
| alkali used NaOH | kg/adtp | — | 8.6 | 13.2 | — | 14.5 | 19.8 |
| kappa number after the stage | | — | 15 | 14.1 | — | 9.3 | 8.4 |
| EOP, $O_2$ | | | | | | | |
| NaOH | kg/adtp | 25 | 17 | 15 | 25 | 17 | 15 |
| $H_2O_2$ | kg/adtp | 6 | 6 | 6 | 6 | 6 | 6 |
| kappa number | | 7.5 | 6.9 | 6.4 | 4.2 | 3.3 | 3.1 |
| viskocity | ml/g | 1182 | 1168 | 1160 | 1150 | 1144 | 1147 |
| brightness | % ISO | 51.2 | 52.5 | 56.6 | 58.8 | 63.3 | 68.1 |
| final PH | | 11.48 | 11.74 | 10.83 | 11.84 | 11.96 | 11.23 |
| total NaOH consumption | kg/adtp | 25 | 25.6 | 28.2 | 25 | 31.5 | 34.8 |

Figure 10:
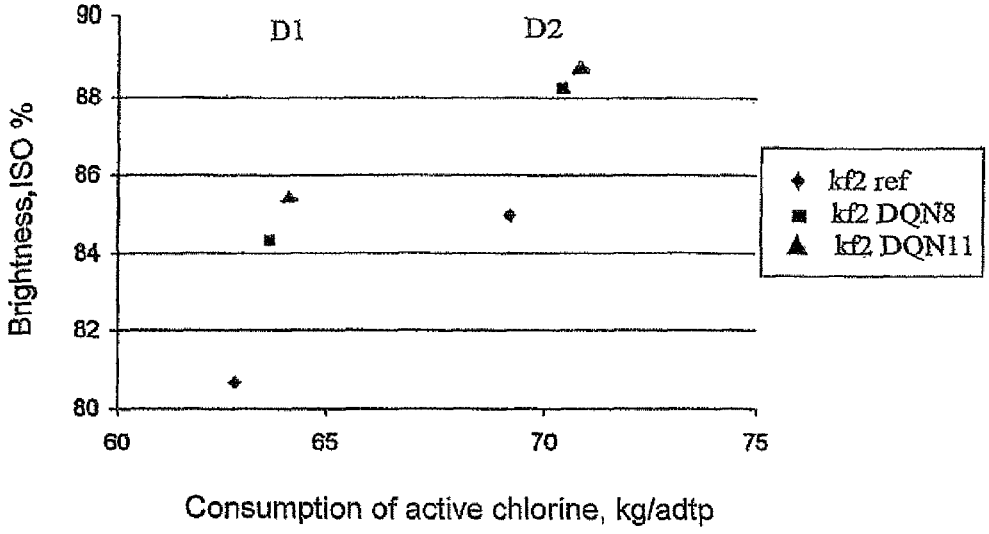
FIG. 10 shows the brightness of three samples in the D1 and D2 stages according to the total consumption of active chlorine.

Using kappa factor 2, the bleached pulps (the reference pulp and the pulp according to the invention) were further subjected to final bleaching using the sequence DnD. In a first D stage (D1) of the final bleaching, the dosage of $ClO_2$ was 15 kg act. Cl/adtp, and in a second D stage (D2) of the final bleaching 5 kg act. Cl/adtp. FIG. 10 shows the brightness of these three samples in the D1 and D2 stages according to the total consumption of active chlorine. With pulps treated according to the invention, said consumption was about 5 kg/adtp lower than with reference pulps with the same brightness, and full brightness (>88% ISO) was obtained only with pulps treated by the DQN stage.

Example 2

Sulphate pulp produced from Eucalyptus was delignified with oxygen, and a kappa number 11.6 was obtained. This pulp was subjected to a DQN treatment according to the invention, followed by an EOP stage (DQN EOP), and as references the DN EOP and D0 EOP initial bleachings.

The dosage of actice chlorine in the D stage was 20% kg/adtp, the temperature 90° C., the retention time 90 min and the final pH 3.7. The final pH of the alkali treatment was 10.8, the treatment time from 5 to 10 min, the temperature 60° C. and the thickness 3%. Chelation was carried out at pH 6, and as chelating agent 1 kg DTPA/adtp was used. The bleaching conditions and the properties measured from the pulp are indicated in table 2.

TABLE 2

| | Ref | D0N | DQN |
|---|---|---|---|
| D stage | | | |
| $ClO_2$, kg act.Cl/adtp | 20 | 20 | 20 |
| DTPA, kg/adtp | | | 1 |
| NaOH kg/adtp | 0 | 8.0 | 8.0 |
| final pH | 3.7 | 10.8 | 10.8 |
| Kappa | 5.0 | 4.9 | 4.7 |
| EOP stage | | | |
| NaOH, kg/t | 12 | 7 | 7 |
| $H_2O_2$, kg/t | 6 | 6 | 6 |
| residual $H_2O_2$ kg/t | 0 | 0.2 | 2.0 |
| Kappa | 4.0 | 4.0 | 3.9 |
| brightness, % ISO | 85.2 | 85.7 | 87.7 |

The D stage removed lignin effectively. The kappa number lowered in the following EOP stage only by about one unit, from which it can be concluded that the pulp still contained a lot of hexenuronic acid groups which are not removed during the alkali treatment.

The chelated pulp had a lowest peroxide consumption which indicates that the removal of metals was effective in the DQN stage, although the pH of the pulp was raised to be alkalic after the chelation prior to washing.

The invention claimed is:

1. A process of bleaching chemical pulp, comprising:

a first chlorine dioxide treatment (D) of initial bleaching and chelation (Q) to be carried out in connection therewith, the chelation being carried out at a pH of from 2 to 7; is followed by an alkalizing treatment (N) of the pulp, without intermediate washing between any of said treatments, for raising the pH of the pulp to a value between 10 and 12; and prior to a following stage, which is a washing step.

2. The process according to claim 1, wherein a chelating agent is added after chlorine dioxide.

3. The process according to claim 1, wherein a chelating agent is added before chlorine dioxide.

4. The process according to claim 1, wherein chlorine dioxide is added in two lots, and a chelating agent is added between these two additions of chlorine dioxide.

5. The process according to claim 1, wherein in the N stage a dosage of alkali is from 1 to 20 kg alkali as NaOH/adtp.

6. The process according to claim 1, wherein in the N stage a treatment time is from 5 sec to 60 min.

7. The process according to claim 1, wherein in said chlorine dioxide treatment the pulp is treated, in addition to chlorine dioxide, also with ozone, peracetic acid or caron acid or a combination thereof.

8. The process according to claim 1, wherein for alkalizing of the pulp sodium hydroxide, white liquor, oxidized white liquor or any combination of these is used.

9. The process according to claim 1, wherein the stage following the washing stage subsequent to the DQN stage is a EOP stage.

10. The process according to claim 1, wherein the filtrate waters resulting from a washer of the DQN stage are led to a container prior to conducting them to an effluent treatment.

11. The process according to claim 1, wherein a hot acid treatment for removing hexenuronic acid groups is carried out in connection with the chlorine dioxide stage.

12. The process according to claim 11, wherein the first three stages of the bleaching are A DQN EOP.

13. The process according to claim 1, wherein the whole sequence of the bleaching is DQN DP.

14. A process of bleaching chemical pulp, comprising:

treating the pulp with chlorine dioxide;

adding chelating agent before or after the step of treating the pulp with chlorine dioxide, where chelation is carried out at a pH of from 2 to 7; followed by alkalizing the pulp, without intermediate washing between any of said steps, to raise the pH of the pulp to a value between 10 and 12; and followed by a washing step.

15. The process according to claim 14, wherein chlorine dioxide is added in two lots, and the chelating agent is added between these two additions of chlorine dioxide.

16. The process according to claim 1, wherein in the alkalizing step a dosage of alkali is from 1 to 20 kg alkali as NaOH/adtp.

* * * * *